United States Patent [19]

Diggs

[11] 4,022,201

[45] May 10, 1977

[54] REBREATHING CAP FOR SKIN DIVERS IN COMBINATION WITH FLOATING SNORKEL ATTACHMENT

[76] Inventor: Richard E. Diggs, S. 12A Road, Carthage, Mo. 64836

[22] Filed: Sept. 4, 1975

[21] Appl. No.: 610,425

[52] U.S. Cl. ..... 128/145 A; 128/142.7

[51] Int. Cl.[2] ..... A62B 7/12

[58] Field of Search ..... 128/145 A, 145 R, 142 R, 128/142.2, 142.3, 142.7, 141 R, 146, 146.5

[56] References Cited

UNITED STATES PATENTS

| | | | |
|---|---|---|---|
| 587,604 | 8/1897 | Pollard | 128/145 R |
| 1,202,197 | 10/1916 | Lippincott | 128/142 R |
| 2,362,775 | 11/1944 | Sebouh | 128/142 R |
| 2,818,067 | 12/1957 | Rebikoff et al. | 128/142.3 |
| 3,433,222 | 3/1969 | Pinto | 128/142.2 |
| 3,467,091 | 9/1969 | Aragona | 128/145 R |

*Primary Examiner*—Robert W. Michell
*Assistant Examiner*—Henry J. Recla
*Attorney, Agent, or Firm*—Eric P. Schellin; Brian L. Ribando

[57] ABSTRACT

There is disclosed a self-contained underwater breathing arrangement including a cap or helmet for a skin diver having a hollow walled arrangement wherein air may be stored for rebreathing as needed. Additionally, there is disclosed, with and without such a combination a snorkel attachment for breathing purposes secured to such a cap having an elongated tube adapted and constructed to extend to the surface of a body of water. The tube terminating on a reel mounted on a floating structure whereby the tube may be wound thereon and unwound as desired.

4 Claims, 12 Drawing Figures

FIG. 1.
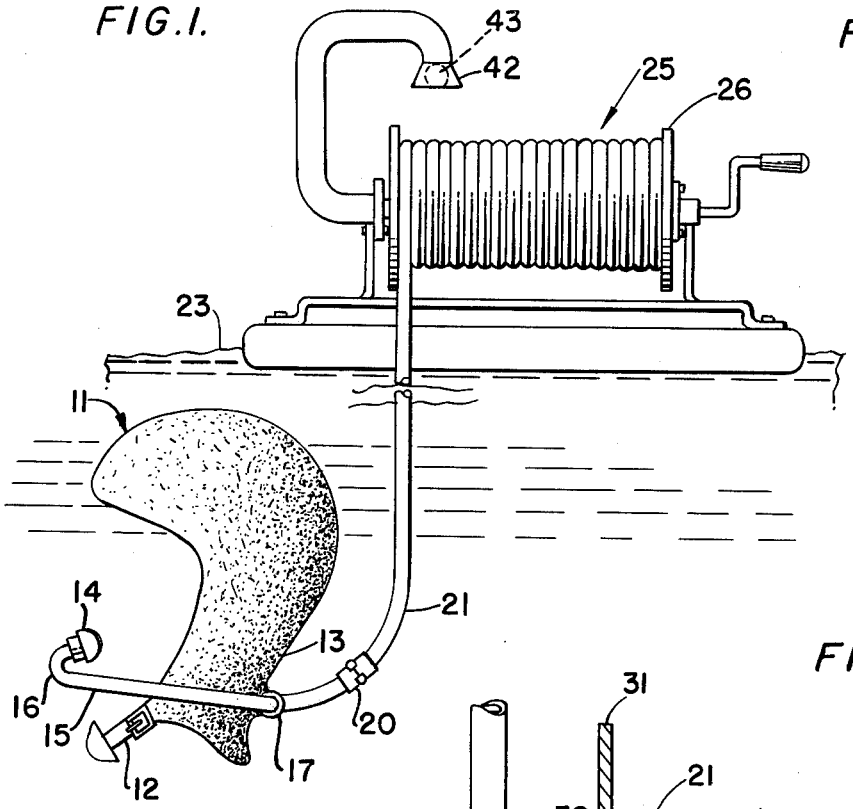
FIG. 2.
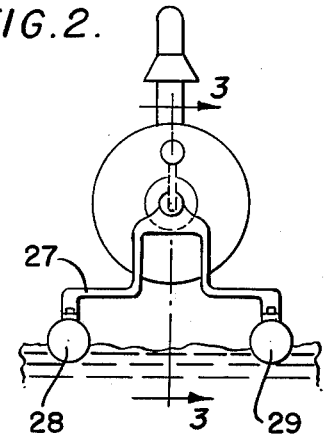
FIG. 3.
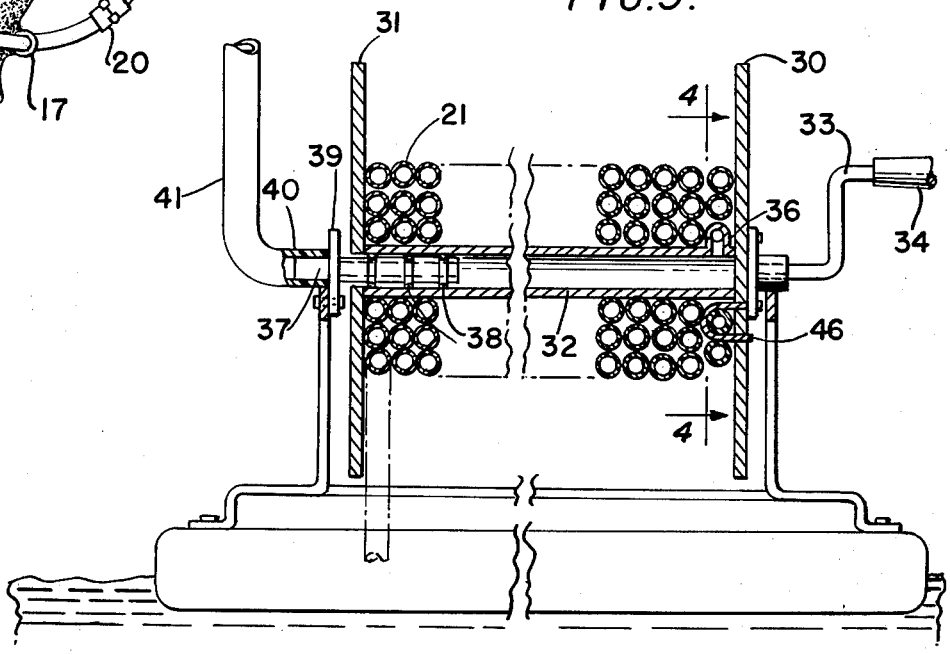
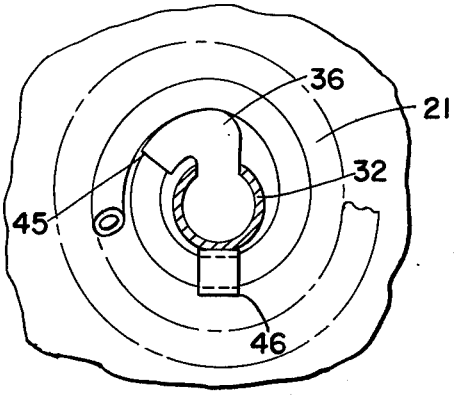
FIG. 4

REBREATHING CAP FOR SKIN DIVERS IN COMBINATION WITH FLOATING SNORKEL ATTACHMENT

BACKGROUND OF THE INVENTION

It will be appreciated that there has been considerable activity in recent years with the idea of being able to explore shallow bodies of clear water for pleasure and for educational purposes. Of course, expensive scuba diving equipment has long been employed for accomplishing such a purpose. Unfortunately, such equipment and the maintenance thereof is an extremely expensive proposition. As a means of accomplishing minor exploratory activity, many skin divers employ a snorkel which merely consists of a rigid tube having a mouthpiece at one end and extending vertically out of the water whereby a continuous air supply may be obtained by the aquanaut. Unfortunately, the depth to which the skin diver may proceed is essentially limited by the length of the tube, except for relatively shallow dives while holding one's breath.

SUMMARY OF THE INVENTION

Accordingly, the present invention is deemed to be an ingenious solution to the problem of the depth that a skin diver may proceed even though the diver may not have expensive scuba diving equipment. Essentially, the present invention includes a cap or helmet which is worn by the diver and, in one embodiment, may have a second outer covering thereover to define a space therebetween. The space in the cap may be utilized by the diver to store air therein as the diver exhales through suitable mouthpiece means and conduit terminating in a manner so that there is communication between the tube and the space in the cap.

In a preferred embodiment, a second mouthpiece, or alternate assembly, with an elongated rigid tube is secured to the cap by a suitable means. An elongated flexible tube having suitable attaching means is attached to the terminus of the rigid tube connected to the mouthpiece in this second embodiment. The elongated tube is of flexible elastomeric material, such as rubber, and extends for up to 100 feet. That portion of the elongated flexible tube not being needed by the submerged diver is maintained on a reel located on a suitable mounting means secured to a float whereby the reel with the remainder un-used portion of the elongated flexible tube being maintained at the surface. The terminus of the elongated flexible tube is connected to a suitable rigid tube having a downwardly facing end having a ball check valve to discourage the ingress of water. The specifics and features of the present invention will become even more clearly apparent from the ensuing detailed description of illustrative embodiments thereof, taken together with the accompanying drawings wherein reference numerals denote like parts throughout the various views.

BRIEF DESCRIPTION OF THE DRAWINGS

FIG. 1 is a perspective view of one embodiment of the invention.

FIG. 2 is a side view of the reel and float arrangement somewhat similar to that of FIG. 1.

FIG. 3 is a cross-sectional view taken along line 3—3 of FIG. 2.

FIG. 4 is a fragmented cross-sectional view taken along line 4—4 of FIG. 3.

DETAILED DESCRIPTION OF THE PREFERRED EMBODIMENTS OF THE PRESENT INVENTION

Figure 5:
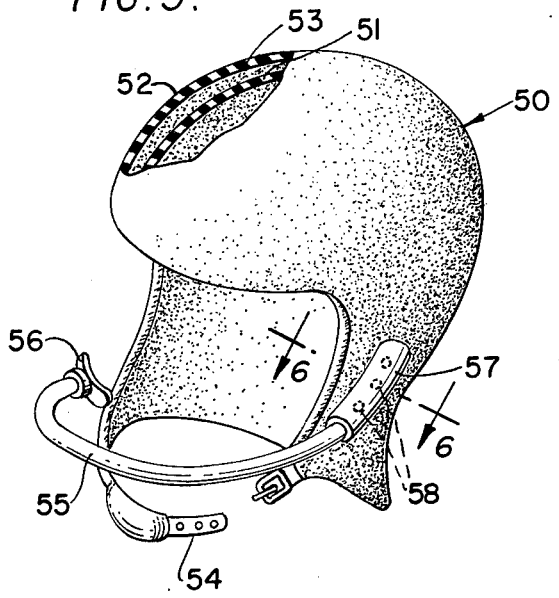
FIG. 5 is a perspective view of one embodiment of the cap of the present invention having a portion fragmented.

Referring now in detail to the drawings, there is shown in FIG. 1 a self-contained breathing apparatus of one type of the present invention. Reference numeral 11, generally, refers to a cap or helmet to be worn by a diver. It will be noted that the cap 11 has essentially a conventional configuration having at the bottom portion thereof a chin strap 12, again of general normal configuration and utility. The cap 11 is constructed to have an elongated descending skirt portion 13 which encompasses the nape of the neck of the diver when worn.

Figure 8:
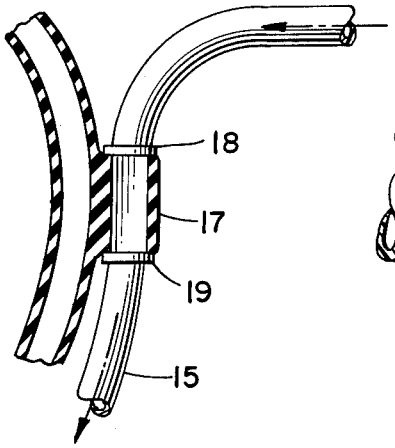
FIG. 8 is a cross-sectional view taken along line 8—8 of FIG. 7.

The mouthpiece 14 is attached to an elongated rigid tube 15 which has a U-shaped portion 16 so that tube 14 extends rearwardly from the diver's face and is attached to a loop arrangement 17 secured to the mentioned neck portion 13 of the cap. Turning momentarily to FIG. 8 for a review of the type of retaining means 17 for rigid tube 15, it will be noted that the retaining means 17 consists of a tubular element and the rigid tube 15 has flanges 18 and 19 secured in spaced relationship so that the rigid tube 15 is fairly securely positioned within the tubular element.

Rigid tube 15 terminates in a coupling 20, more of which will be stated below. The other side of the coupling 20 has positioned thereon an elongated flexible hose 21. The hose 21 extends upwardly to the surface of a body of water 23 on which there is floating, generally, a snorkel arrangement 25. The snorkel arrangement 25 shown in FIG. 1 should be reviewed with FIGS. 2 and 3. It will be noted that the snorkel arrangement 25 includes a hose reel 26 which is suitably positioned on bifurcated support means 27. The legs of the support means 27 are secured to elongated floats 28 and 29 which consist of foamed synthetic plastic material of fairly large cylinders coated with a polyester plastic material in order to provide protection against damage.

The reel 26 possesses side flanges 30 and 31 with a connecting tube 32 therebetween. The hose 21 is wound onto the reel as a result of a motion by attached thereto crank 33 which has a handle 34. The crank 33 may be rotated by means of handle 34 so that the reel 26 may either unwind or wind up hose 21. Connection to hose 21 from the reel is made by employing tube 32 which has a suitable fitting 36 whereby hose 21 at the end portion thereof may be affixed to the fitting. At the other end of tube 32 a plastic fitting 37 is positioned which has suitable sealing means so that as tube 32 rotates the fitting 37 remains relatively stationary. This is accomplished by constructing fitting 37 to have at one end portion of the outer surface thereof three grooves 38 into which sealing O-rings are positioned in a conventional manner. The grooves 38 are spaced. Tube 37 has a flange 39 and another short stub tube 40 to which a fixed rigid tube 41 is positioned which has a U-shaped configuration at the upper end thereof terminating in a cage 42 which contains a conventional ball check valve 43.

For a consideration of fitting 36, attention is directed to FIG. 4 where it will be seen that tube 21 is wound about tube 32. The fitting 36 consists of an elbow of tubular plastic material that may be transparent so that any water that may be present may be observed therein. The terminal end of hose 21 is secured to fitting 36 at 45. So that tube 21 is not dislodged from the reel when the entire reel has been unwound, and the hose 21 may be under tension, a U-shaped clip 46 is secured to the inside portion of flange 30 of the reel 26 as can be more clearly discerned from FIG. 3.

Figure 6:
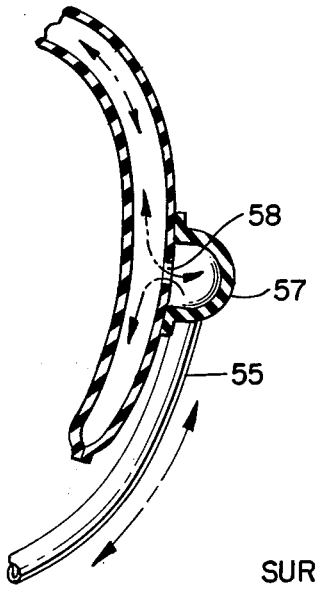
FIG. 6 is a cross-sectional view taken along line 6—6 of FIG. 5.

Turning now for even more detailed consideration of various component parts of the present invention, attention is now directed to FIGS. 5 and 6 for one embodiment of the present invention. It will be seen that from FIGS. 5 and 6 a cap or helmet 50 has an inner lining 51 and spaced therefrom outwardly is the outer covering 52. It will be noted that a space 53 is defined therebetween as the helmet 50 is fragmented near the forehead portion thereof. Again, the helmet 50 has a suitable chin strap 54 as mentioned heretofore. In this embodiment, an elongated rigid tube 55 having a general U-shaped configuration has at one end thereof a conventional mouthpiece 56. The other end of the tube 55 terminates in a small manifold 57 as seen more clearly in the cross-sectional view of FIG. 6. Manifold 57 provides a communicating space between tube 55 and the space 53 through a plurality of openings 58 shown by dotted lines in FIG. 5 and numbering 3.

In operation of the concept shown in FIGS. 5 and 6, the diver after donning the helmet, which is constructed of rubber material, for instance, so has a good degree of elasticity and produces an excellent ballooning effect, hyperventilates, in a conventional manner, and then takes the mouthpiece in the diver's mouth and submerges in a conventional manner. Instead of exhaling the air captured in the diver's lungs as would be conventional, the diver exhales and stores the air into space 53 creating a ballooning effect. The diver may then re-inhale the air and may do so for three or four more occasions before the carbon dioxide level in the employed air becomes too high requiring the diver to surface. The diver may then hyperventilate again for a second dive of similar proportions.

Figure 7:
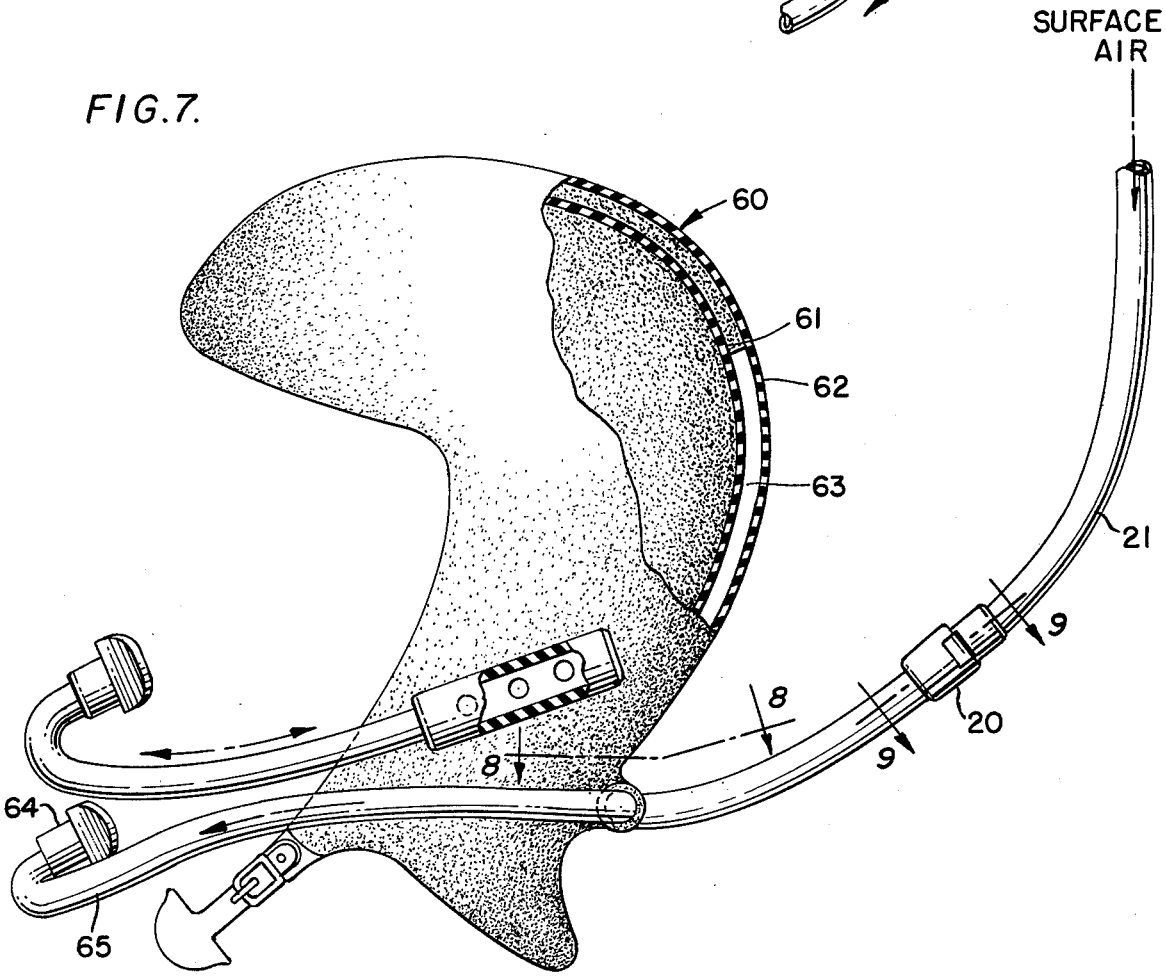
FIG. 7 is a side view partially in cross-section of another embodiment of the cap of the present invention.

Now, turning to the embodiment of FIG. 7 which is herein deemed to be the preferred embodiment of the present invention. It will be noted that FIG. 7 depicts another helmet 60 having an inner lining 61 and an outer covering 62 much as in the concept of FIG. 5. A space 63 is again defined between the inner lining and the outer covering. In this embodiment it will be seen that the helmet possesses two secured thereto mouthpieces. The upper mouthpiece is similar to the mouthpiece and tube and manifold means as shown in FIG. 5 so that no special additional attention need be given thereto. On the other hand, it will be noted that the second lower positioned mouthpiece 64 is secured to an elongated rigid tube 65 which has a U-shaped configuration so that it extends rearwardly of the helmet and the diver as in the concept shown generally in FIG. 1. Note again, the coupling means 20 and the flexible hose 21 which is led to the surface in the mannner exemplified in FIG. 1.

For a consideration of the unique coupling means 20, attention is directed to FIGS. 9, 10, 11, and 12. It will be noted that rigid tube 65 terminates centrally in the bottom 70 of a tubular open ended housing 66 having mounted therein a valve arrangement 67 which has an annular seat 68 against which it normally seats as seen from FIG. 11 due to the aegis of helical spring 69 mounted in the housing 66 with one end in abutment against the surface of the valve arrangement 67 opposite to the seating means and the other end of the spring in abutment against the bottom 70 of the housing 66. A guide pin 71 is also positioned at the opposite side of the effective valve arrangement. The effective part of the valve extends outwardly of the housing 66 and terminates in a projection 72 which possesses grooves 73 therein so that when the valve arrangement 67 is unseated from its seat 68 there is communication around the seat 68 due to the groves.

Figure 9:
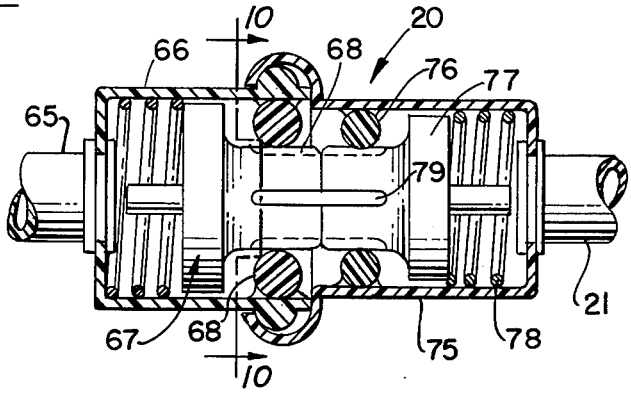
FIG. 9 is a cross-sectional view taken along line 9—9 of FIG. 7.
Figure 10:
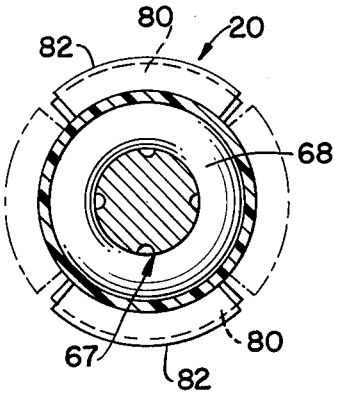
FIG. 10 is a cross-sectional view taken along line 10—10 of FIG. 9.
Figure 11:
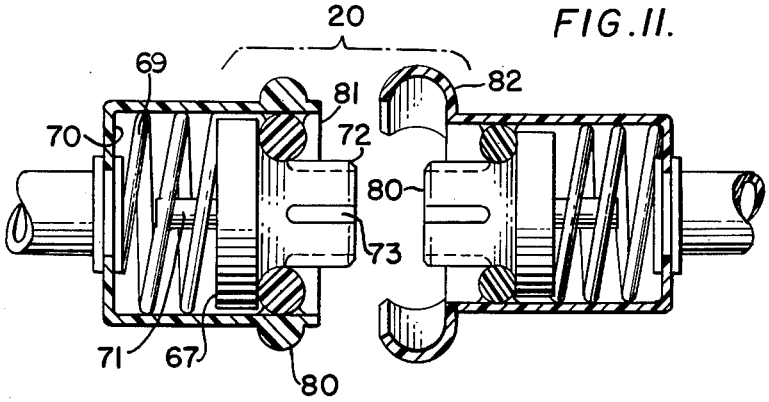
FIG. 11 is the same cross-sectional view as demonstrated in FIG. 9 with the connecting means exploded.
Figure 12:
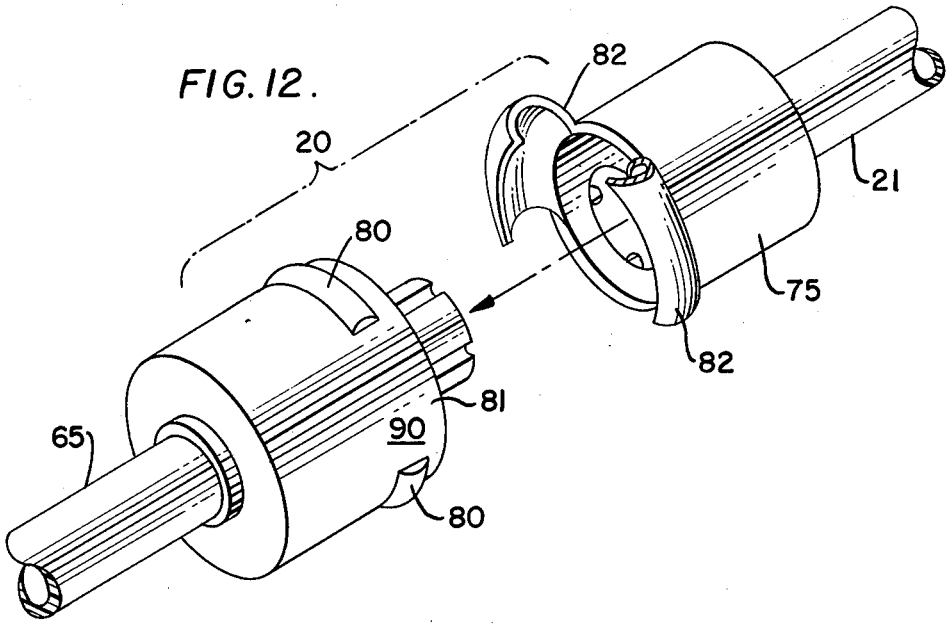
FIG. 12 is a perspective view showing the similar structure as that shown in FIG. 11.

The other side of the coupling 20 also includes an oppositely disposed open ended housing 75 which is secured to the hose 21. A seat 76 is also positioned annularly in the housing and a valve arrangement 77 is positioned at one side of the seat in a mirror image to the first valve arrangement 67 discussed above. Again, a helical spring 78 is employed to normally close the valve against seat 76 and bottom 69 of the housing 75. Grooves 79 are also present in a projection 80. The coupling effect is accomplished by virtue of a bayonet-like arrangement whereby housing 66 has interrupted arcuate projections 80 along the upper outer surface 81 near the opening of the housing 66. Mating means consisting of arcuate flangers 82 are positioned in interrupted fashion on housing 75. When it is desired to make the coupling, the flanges 82 on housing 75 are slid over an area 90 not having the arcuate projections 80. Housing 75 and housing 66 are turned angularly relative to one another so that projections 80 become locked into position within the flanges 82 as shown in FIG. 9, for instance. When this is accomplished the forward surfaces of projections 72 and 80 are in confrontation and move the valves to unseat them to provide communication between tube 65 and hose 21.

In use, the preferred embodiment is utilized by moving the floating hose reel carrying means to a desirable position over a body of water. The diver secures his helmet or cap in a conventional manner and prior thereto couples the hose 21 to either tube 65 of the embodiment shown in FIG. 7 or to the embodiment shown in FIG 1 the diver may then descend into the body of water and by pulling on hose 21 will unwind a sufficient line of hose 21 as is necessary. The diver may then breathe through mouthpiece 64 of the embodiment of FIG. 7 or mouthpiece 14 of the embodiment of FIG. 1 for as long a period as is comfortable and may move about under water undertaking various pleasurable and educational tasks. Upon surfacing, the diver may then uncouple the hose 21 from his helmet and will, of course, rewind the hose 21 onto the reel arrangement 25. The advantage in having the reel as a floating device will be seen in that it may be towed to a position either by a boat or by the swimmer. The device is light enough so that if it is necessary to take it into the boat if one is used, this may be readily accomplished.

Of course, as in the preferred embodiment shown the helmet having two mouthpieces may be used as in the first embodiment as a rebreathing device. In such an arrangement the helmet may be used to store exhaled air and the second conduit 65 may be removed.

It will be readily seen that many of the items employed in the present invention may be constructed of soft rubber, such as in the cap, or may be constructed of rigid plastic, such as some of the tubes. Additionally, objects or structures that must be constructed of metal should be constructed of either stainless steel or aluminum in order to avoid corrosion. Of course, the selection of the materials of construction may vary as desired.

It will be appreciated that a preferred embodiment of the principles of this invention having been described and illustrated, it is to be realized that modifications thereof can be made without departing from the broad spirit and scope of this invention as defined in the appended claims.

What is claimed is:

1. Breathing apparatus comprising a float, a reel mounted on said float, said reel having a tubular axle, a hose wound on said reel, one end of said hose connected to means whereby said hose is in internal communication with said tubular axle, a fixed tubular fitting means communicating with one end of said tubular axle, said hose affixed at one end to said fixed tubular fitting, the other end of said hose terminating with one end of a coupling, said other end of said coupling affixed to a first conduit, a flexible cap having an inner lining and an outer cover of relatively elastomeric material hermetically bound together at their peripheral edges thereby defining a space therebetween, said cap having secured thereto a second conduit means having means for unobstructed communication with said defined space, said second conduit terminating in a mouthpiece, said cap further comprising a depending skirt portion adapted and constructed to cover the nape of a diver, said skirt portion having retaining means for said conduit, said first conduit extending forwardly of said cap and terminating in a mouthpiece.

2. The apparatus of claim 1 wherein the coupling means includes an open ended housing attached to said hose and an open ended housing attached to one end of said first conduit, said housings having normally closed valve means with outwardly urged projecting means whereby said valves are opened when said housing are axially brought together in a manner so that said relative projections are in abutment, said housings having means to couple.

3. The apparatus of claim 1 wherein the other end of said fixed tubular fitting terminates in a check valve.

4. A diver's cap having an inner lining and an outer cover of highly elastomeric material hermetically bound together at their peripheral edges thereby defining an expansible space therebetween, rebreathing means for said diver including a conduit secured to said cap, means for unobstructed communication between said defined space and said conduit, and a mouthpiece terminating said conduit, whereby air exhaled by said diver may be temporarily stored in said spaced and thereafter inhaled by said diver.

* * * * *